United States Patent [19]

Sato et al.

[11] 4,053,318

[45] Oct. 11, 1977

[54] SILVER HALIDE PHOTOGRAPHIC EMULSIONS

[75] Inventors: Akira Sato; Akira Ogawa; Masanao Hinata; Haruo Takei, all of Minami-ashigara, Japan

[73] Assignee: Fuji Photo Film Co., Ltd., Minami-ashigara, Japan

[21] Appl. No.: 642,207

[22] Filed: Dec. 18, 1975

[30] Foreign Application Priority Data

Dec. 18, 1974 Japan ..... 49-145176

[51] Int. Cl.[2] ..... G03C 1/10; G03C 1/22

[52] U.S. Cl. ..... 96/139; 96/140

[58] Field of Search ..... 96/139, 140

[56] References Cited

U.S. PATENT DOCUMENTS

| | | | |
|---|---|---|---|
| 3,698,910 | 10/1972 | Sakazume et al. | 96/140 |
| 3,822,136 | 7/1974 | Sakazume et al. | 96/140 |
| 3,951,666 | 4/1976 | Hinata et al. | 96/140 |

*Primary Examiner*—J. Travis Brown

*Attorney, Agent, or Firm*—Sughrue, Rothwell, Mion, Zinn and Macpeak

[57] ABSTRACT

A silver halide photographic emulsion containing at least one spectral sensitizing dye represented by formula (I)

(I)

wherein Z is an atomic group necessary for completing a 5- or 6-membered heterocyclic ring, $R_1$ is an aliphatic group, $R_2$ is an aliphatic group having an alkylthio group or an aliphatic group having two alkoxy groups on the same carbon atom, $R_3$ is an aryl group, an alkyl group or an alkenyl group, $R_4$ is a hydrogen atom, an alkyl group or an aryl group, and m and n are 1 or 2.

7 Claims, No Drawings

SILVER HALIDE PHOTOGRAPHIC EMULSIONS

BACKGROUND OF THE INVENTION

1. FIELD OF THE INVENTION

The present invention relates to a silver halide photographic emulsion spectrally sensitized with a novel merocyanine dye, and, more particularly, to a silver halide photographic emulsion having high blue- and green-sensitivities.

2. DESCRIPTION OF THE PRIOR ART

Many kinds of cyanine and merocyanine dyes have been used for the spectral sensitization of silver halide photographic emulsions. Of such dyes, merocyanine dyes are disclosed in U.S. Pat. Nos. 2,493,747, 2,493,748, 2,497,876, 2,519,001, 3,384,486, 3,480,439, 3,625,698, 3,765,901, etc. Though many kinds of merocyanine dyes have been used as above, the practical spectral sensitization powers thereof are not sufficient. Some merocyanine dyes can provide a good spectral sensitizing function but cannot be practically used because they often cause fog and decrease the sensitivity of light-sensitive materials during storage thereof. Further, such dyes often remain in silver halide emulsion layers after development and stain the photographic images therein. It has long been desired in the art to overcome these technical problems of the merocyanine dyes.

SUMMARY OF THE INVENTION

A first object of this invention is to provide a silver halide photographic emulsion which is strongly spectrally sensitized and undergoes less fog.

A second object of this invention is to provide a spectrally sensitized silver halide photographic emulsion wherein sensitivity hardly decreases even after light-sensitive materials comprising the emulsion have been stored for a long period of time.

A third object of the invention is to provide a silver halide photographic emulsion spectrally sensitized with a spectral sensitizing dye having good solubility and which is incapable of staining the photographic images after development.

These objects of the invention are attained by incorporating a novel merocyanine dye represented by formula (I) into a silver halide photographic emulsion.

(I)

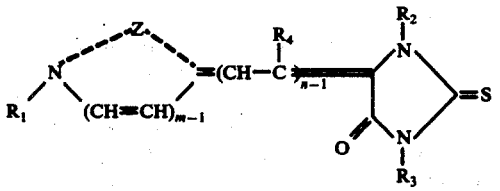

wherein Z is an atomic group necessary for completing a 5- or 6-membered heterocyclic nucleus in which one or more carbon atoms of the heterocyclic ring can be substituted, wherein preferred atomic groups comprise carbon and one or more of nitrogen, oxygen, sulfur or selenium. As examples of such a nucleus, there is an oxazole nucleus, e.g., oxazole, 4-methyloxazole, 5-methyloxazole, 4-phenyloxazole, 4,5-diphenyloxazole, 4-ethyloxazole, 4,5-dimethyloxazole or 5-phenyloxazole; a benzoxazole nucleus, e.g., benzoxazole, 5-chlorobenzoxazole, 5-methylbenzoxazole, 5-phenylbenzoxazole, 6-methylbenzoxazole, 5,6-dimethylbenzoxazole, 5-methoxycarbonylbenzoxazole, 5-methoxybenzoxazole, 5-ethoxybenzoxazole, 5-chlorobenzoxazole, 5-trifluoromethylbenzoxazole, 5-hydroxybenzoxazole or 6-hydroxybenzoxazole; a benzisooxazole nucleus, e.g., benzisooxazole, 5-chlorobenzoisooxazole, 4,6-dichlorobenzisooxazole, 4,6-dibromobenzisooxazole, 7-methylbenzisooxazole, 6-methylbenzisooxazole, 6,7-dimethylbenzisooxazole, 7-ethylbenzisooxazole, 7-methoxybenzisooxazole, 6-methoxybenzisooxazole, 6-hydroxybenzisooxazole, 7-phenylbenzisooxazole or 5-chloro-7-ethylbenzisooxazole; a naphthoxazole nucleus, e.g., α-naphthoxazole, β,β-naphthoxazole, β-naphthoxazole or 7-hydroxy-β-naphthoxazole; a thiazoline nucleus, e.g., thiazoline or 4-methylthiazoline; a thiazole nucleus, e.g., thiazole, 4-methylthiazole, 4-phenylthiazole, 4-(p-hydroxyphenyl)thiazole, 5-methylthiazole, 5-phenylthiazole, 4,5-dimethylthiazole or 4,5-diphenylthiazole; a benzothiazole nucleus, e.g., benzothiazole, 5-hydroxybenzothiazole, 5-fluorobenzothiazole, 4-chlorobenzothiazole, 5-chlorobenzothiazole, 6-chlorobenzothiazole, 7-chlorobenzothiazole, 7-methylbenzothiazole, 5-methylbenzothiazole, 6-methylbenzothiazole, 5,6-dimethylbenzothiazole, 5-bromobenzothiazole, 6-bromobenzothiazole, 5-phenylbenzothiazole, 6-phenylbenzothiazole, 7-phenylbenzothiazole, 4-methoxybenzothiazole, 5-methoxybenzothiazole, 6-methoxybenzothiazole, 7-methoxybenzothiazole, 5-iodobenzothiazole, 6-iodobenzothiazole, 5-ethoxybenzothiazole, 6-ethoxybenzothiazole, 5-ethoxycarbonylbenzothiazole, tetrahydrobenzothiazole, 5-(N,N-dimethylamide)benzothiazole, 5,6-dimethoxybenzothiazole, 5-hydroxybenzothiazole or 6-hydroxybenzothiazole; a naphthothiazole nucleus, e.g., α-naphthothiazole, β-naphthothiazole, β,β-naphthothiazole, 5-methoxy-β-naphthothiazole, 5-ethoxy-β-naphthothiazole, 7-methoxy-α-naphthothiazole, 5-hydroxy-β-naphthothiazole, 7-hydroxy-α-naphthothiazole or 5-ethyl-β-naphthothiazole; a selenazole nucleus, e.g., selenazole, 4-methylselenazole, or 4-phenylselenazole; a benzoselenazole nucleus, e.g., benzoselenazole, 5-chlorobenzoselenazole, 5-methoxybenzoselenazole, 5-hydroxybenzoselenazole or tetrahydroxybenzoselenazole; a naphthoselenazole nucleus, e.g., α-naphthoselenazole, β,β-naphthoselenazole or β-naphthoselenazole; a 2-quinoline nucleus, e.g., 2-quinoline, 3-methyl-2-quinoline, 6-methyl-2-quinoline, 8-methyl-2-quinoline, 6-chloro-2-quinoline, 8-chloro-2-quinoline, 8-fluoro-2-quinoline, 6-methoxy-2-quinoline, 6-ethoxy-2-quinoline, 6-hydroxy-2-quinoline or 8-hydroxy-2-quinoline; a 4-quinoline nucleus, e.g., 4-quinoline, 6-methoxy-4-quinoline, 8-methoxy-4-quinoline, 6-methyl-4-quinoline, 8chloro-4-quinoline or 8-trifluoromethyl-4-quinoline; a 1-isoquinoline nucleus, e.g., 1-isoquinoline, 3-methyl-1-isoquinoline, 4-methyl-1-isoquinoline, 7-methyl-1-isoquinoline, 8-ethyl-1-isoquinoline, 6-chloro-1-isoquinoline, 6-methoxy-1-isoquinoline or 8-ethoxy-1-isoquinoline; a 3-isoquinoline nucleus, e.g., 3-isoquinoline, 5-methyl-3-isoquinoline, 7-methyl-3-isoquinoline, 6-chloro-3-isoquinoline, 6-methoxy-3-isoquinoline or 8-ethoxy-3-isoquinoline; an indolenine nucleus, e.g., indolenine, 3,3-dimethylindolenine, 5-hydroxy-3,3-dimethylindolenine, 3,3-dimethyl-6-chloroindolenine or 3,3,5-trimethylindolenine; a 2-pyridine nucleus, e.g., 2-pyridine, 4-butyl-2-pyridine, 4-octadecyl-2-pyridine, 4,6-dibutyl-2-pyridine, 4-benzyl-2-pyridine, 4-phenyl-2-pyridine, 4,6-diphenyl-2-pyridine, 4,6-dinaphthyl-2-pyridine, 5-bromo-2-pyridine, 3-methoxy-2-pyridine, 6-ethoxy-2-pyridine or 4,6-diethoxy-2-pyridine; a 4-pyridine nucleus, e.g., 4-pyridine, 2-butyl-4-pyridine, 2-decyl-4-pyridine, 2-octadecyl-4-pyridine, 2,6-dibutyl-4-pyridine, 2-benzyl-4-pyridine, 2-phenyl-4-pyridine or 2,6-diphenyl-4-pyridine; a benzimidazole nucleus, e.g., benzimidazole, 1-ethylbenzimidazole, 5-chloro-1-ethylbenzimidazole, 5,6-dichloro-1-ethylbenzimidazole or 5,6-dichloro-1-methylbenzimidazole; a naphthoimidazole nucleus, e.g., 1-ethyl-α-naphthoimidazole, 1-ethyl-β,β-naphthoimidazole or 1-ethyl-β-naphthoimidazole; a pyrrole nucleus, e.g., pyrrole, 3-ethylpyrrole, 4-ethylpyrrole, 5-ethylpyrrole or 5-phenylpyrrole; a pyrrolidine nucleus, e.g., pyrrolidine, 3-ethylpyrrolidine, 4-ethylpyrrolidine or 5-ethylpyrrolidine; a tetrazole nucleus, e.g., 1-ethyltetrazole, 1-phenyltetrazole or 1-methyltetrazole; etc.

$R_1$ is an aliphatic group such as an alkyl group (preferably having 1 to 8 carbon atoms in the alkyl chain thereof, exclusive of substituents), which term includes not only unsubstituted alkyl groups, e.g., methyl, ethyl, propyl or butyl but substituted alkyl groups (preferably having an alkyl moiety of 1 to 8 carbon atoms), for example, an alkyl group substituted with a sulfo group [such as a sulfoalkyl group (e.g., -sulfoethyl, γsulfopropyl, γ-sulfobutyl or δsulfobutyl), a sulfoalkoxyalkyl group (e.g., sulfoethoxyethyl or sulfopropoxyethoxyethyl), a hydroxysulfoalkyl group (e.g., 2-hydroxy-3-sulfopropyl), etc.], a carboxyalkyl group (e.g., β-carboxyethyl, Ω-carboxybutyl or carboxymethyl), a hydroxyalkyl group (e.g., β-hydroxyethyl or γ-hydroxypropyl), an alkoxyalkyl group [which term includes an unsubstituted alkoxyalkyl group (e.g., β-methoxyethyl or γ-methoxypropyl) and an alkoxyalkyl group substituted with a hydroxy or acyloxy group, e.g., a hydroxyalkoxyalkyl group (e.g., hydroxymethoxymethyl, 2-hydroxymethoxymethyl, 2-hydroxyethoxymethyl or 2-(2-hydroxyethoxy)ethyl) or an acyloxyalkoxylalkyl group wherein alkyl moiety of the acyloxy group has 1 to 8 carbon atoms, preferably 1 to 6 carbon atoms, more preferably 1 to 4 carbon atoms (e.g., 2-(2-acetoxyethoxy)ethyl or acetoxymethoxymethyl)], an acyloxyalkyl group (where the acyl moiety preferably has 1 to 8, more preferably 1 to 6, most preferably 1 to 4 carbon atoms, e.g., β-acetoxyethyl or Ω-propionyloxybutyl), an alkoxycarbonylalkyl group (e.g., methoxycarbonylmethyl, β-methoxycarbonylethyl or Ω-ethoxycarbonylbutyl), a sulfoxyalkyl group (e.g., β-sulfoxyethyl or Ω-sulfoxybutyl), wherein the alkyl moiety of any substituents (e.g., alkoxy or acyloxy groups) has up to 8 carbon atoms, preferably up to 6 carbon atoms, more preferably up to 4 carbon atoms; an aralkyl group, preferably an aralkyl group comprising a monoaryl group as the aryl moiety and having alkyl moiety of 1 to 6 carbon atoms, preferably 1 to 4 carbon atom, more preferably 1 to 2 carbon atoms (e.g., benzyl, phenylethyl or p-sulfobenzyl) or an alkenyl group (e.g., an allyl group), etc.

$R_2$ is an aliphatic group substituted with an alkylthio group or an aliphatic group substituted with two alkoxy groups on the same carbon atom thereof, wherein the term "alkylthio group" includes an alkenylthio group (e.g., an allylthio group). The alkyl moiety of the alkylthio group and the alkoxy groups preferably have 1 to 6 carbon atoms, more preferably 1 to 4 carbon atoms, most preferably 1 to 3 carbon atoms, and such terms include a substituted alkylthio group and alkoxy group, for example, with an alkoxy group, a cyano group, a carbamoyl group, a hydroxy group, an amino group, an alkoxycarbonyl group or a carboxy group, preferably an alkoxy, hydroxy, alkoxycarbonyl or carboxy group and most preferably a hydroxy or carboxy group. The aliphatic groups preferably have 1 to 8 carbon atoms, more preferably 1 to 6 carbon atoms, most preferably 1 to 4 carbon atoms.

Examples of aliphatic groups having an alkylthio group include a 2-(allylthio)ethyl, 3-(allylthio)propyl, 2-(ethylthio)ethyl, 2-(methylthio)ethyl, 2-[2-(methoxy)ethylthio]ethyl, 2-[2-(cyano)ethylthio]ethyl, 2-[2-(carbamoyl)ethylthio]ethyl, 2-(carbamoylmethylthio)ethyl, 2-[2-(hydroxy)ethylthio]propyl, 2-[2-(N,N-dimethylamino)ethylthio]ethyl, 2-(ethoxycarbonylmethylthio)ethyl, 2-[2-(ethoxycarbonyl)ethylthio]ethyl and a 2-carboxymethylthio)ethyl group.

Examples of aliphatic groups having two alkoxy groups on the same carbon atom, where the alkyl moiety of the alkoxy group has 1 to 6 carbon atoms, preferably 1 to 4 carbon atoms, more preferably 1 to 3 carbon atoms, include those having 1 to 8 carbon atoms, preferably 1 to 6 carbon atoms, more preferably 1 to 4 carbon atoms, e.g., a 2,2-diethoxyethyl, 3,3-diethoxypropyl, 2,2-diethoxypropyl, 2,2-dimethoxyethyl, 2,2-di-n-propyloxyethyl, 4,4-diethoxybutyl and a 2,2-dimethoxypropyl group.

$R_3$ is an aryl group, i.e., an unsubstituted aryl group, e.g., phenyl group, or a substituted aryl group (as the substituents, an alkyl group, alkoxy group, carboxy group, halogen atom, alkoxycarbonyl group, sulfo group, etc., preferably carboxy, halogen or sulfo and most preferably carboxy or halogen, where any alkyl moiety alone or in combination, with, e.g., oxy, preferably has 1 to 4 carbon atoms), e.g., an m-tolyl, p-tolyl, p-methoxyphenyl, p-carboxyphenyl, p-ethoxycarbonylphenyl, p-chlorophenyl or a p-sulfophenyl group; an alkyl group, i.e., an unsubstituted alkyl group (preferably of 1 to 6 carbon atoms), e.g., a methyl, ethyl or propyl group; or a substituted alkyl group (as the substituents, an alkoxy group, carboxy group, sulfo group, alkoxycarbonyl group, dialkylamino group, etc., where an alkyl moiety alone or in combination with, e.g., oxy, preferably has 1 to 6 carbon atoms), e.g., a sulfoethyl, carboxymethyl, methoxyethyl, ethoxycarbonylmethyl or an N,N-dimethylaminoethyl group); or an alkenyl group, e.g., an allyl group.

$R_4$ is a hydrogen atom, an alkyl group having 1 to 6 carbon atoms, preferably 1 to 4 carbon atoms, most preferably 1 to 2 carbon atoms (which term includes unsubstituted and substituted alkyl groups with a hydroxy group or a carboxy group), e.g., a methyl, ethyl, 2-hydroxyethyl or a carboxymethyl group, an aryl group (which term includes unsubstituted and substituted monoaryl groups, e.g., a phenyl group or a phenyl group substituted with an alkyl, carboxy, alkoxy or alkoxycarbonyl group or a halogen atom, preferably those substituted with an alkyl or carboxy group or a halogen atom, most preferably those substituted with an alkyl or carboxy group), e.g., a phenyl, p-tolyl, o-carboxyphenyl or a p-chlorophenyl group.

*m* and *n* are each 1 or 2.

Preferred merocyanine dyes in this invention are those represented by formula (I) in which Z is a benzoxazole nucleus, a benzisooxazole nucleus, a naphthoxazole nucleus, a thiazoline nucleus, a thiazole nucleus, a benzothiazole nucleus, a naphthothiazole nucleus, a benzoselenazole nucleus, a 2-pyridine nucleus, a 4-pyridine nucleus, a benzimidazole nucleus or a pyrrolidine nucleus as earlier defined; $R_1$ is an alkyl group, which term includes unsubstituted alkyl groups having 1 to 6 carbon atoms (e.g., a methyl, ethyl or n-propyl group)

and substituted alkyl groups having a main alkyl moiety of 1 to 6 carbon atoms (e.g., a sulfoalkyl, sulfoalkoxyalkyl, where the alkoxy moiety has 1 to 8 carbon atoms, preferably 1 to 6 carbon atoms, more preferably 1 to 4 carbon atoms, hydroxysulfoalkyl, carboxyalkyl group, sulfoxyalkyl or alkenyl group, e.g., allyl group); $R_2$ is an alkyl group of 1 to 4 carbon atoms having an alkylthio group (which term includes an alkenylthio group, e.g., allylthio group) wherein the alkyl moiety has 1 to 4 carbon atoms or an alkyl group having 1 to 6 carbon atoms having two alkoxy groups on the same carbon atom thereof where the alkyl moiety of the alkoxy group has 1 to 4 carbon atoms; $R_3$ is an unsubstituted phenyl group, a p-carboxyphenyl group, a p-chlorophenyl group, a p-sulfophenyl group, an unsubstituted alkyl group having 1 to 6 carbon atoms (e.g., a methyl, ethyl or propyl group), a sulfoalkyl group having an alkyl moiety of 1 to 6 carbon atoms, a carboxyalkyl group having an alkyl moiety of 1 to 6 carbon atoms, an alkoxycarbonylalkyl group having an alkyl moiety of 1 to 6 carbon atoms and an alkoxy moiety of 1 to 8 carbon atoms, preferably 1 to 6 carbon atoms, more preferably 1 to 3 carbon atoms, or an alkenyl group, e.g., an allyl group; $R_4$ is a hydrogen atom, an alkyl group having 1 to 4 carbon atoms, preferably 1 to 2 carbon atoms, a phenyl group or a substituted phenyl group (wherein the phenyl group is substituted with an alkyl, carboxy, alkoxy or alkoxycarbonyl group or a halogen atom, preferably those substituted with an alkyl or carboxy group or a halogen atom, most preferably those substituted with an alkyl or carboxy group) e.g., a phenyl group, p-tolyl, o-carboxyphenyl or a p-chlorophenyl group; and $n$ is 1 or 2.

More preferred dyes in the invention are those represented by formula (I) in which Z is a benzoxazole nucleus, a benzisooxazole nucleus or a naphthoxazole nucleus; and $R_2$ is an alkyl group having 1 to 4 carbon atoms and having two alkoxy groups on the same carbon atom (the alkyl moiety of the alkoxy group having 1 to 3 carbon atoms) such as a 2,2-diethoxyethyl, 2,2-dimethoxyethyl or 2,2-diethoxypropyl group. In this case, more preferably $R_1$ is an unsubstituted alkyl group having 1 to 4 carbon atoms (e.g., a methyl, ethyl or isopropyl group), a hydroxyalkyl group having an alkyl moiety of 1 to 4 carbon atoms (e.g., a $\beta$-hydroxyethyl or $\gamma$-hydroxypropyl group), a sulfoalkyl group having an alkyl moiety of 1 to 4 carbon atoms (e.g., a $\beta$-sulfoethyl, $\alpha$-sulfopropyl group or $\gamma$-sulfobutyl group), a carboxyalkyl group having an alkyl moiety of 1 to 4 carbon atoms (e.g., a carboxymethyl or beta-carboxyethyl group) or an alkenyl group (e.g., an allyl group); $R_3$ is a phenyl group, a p-chlorophenyl group, a p-carboxyphenyl group, an unsubstituted alkyl group having 1 to 4 carbon atoms (e.g., a methyl, ethyl or n-propyl group), a substituted alkyl group having an alkyl moiety of 1 to 4 carbon atoms and substituted with a sulfo group, a carboxy group, or an alkoxycarbonyl group (e.g., a sulfoethyl, carboxymethyl, methoxycarbonylmethyl or ethoxycarbonylmethyl group) or an alkenyl group (e.g., an allyl group); and $R_4$ is a hydrogen atom or a lower alkyl group (i.e a methyl group or ethyl group).

Typical examples of merocyanine dyes employed in this invention are shown below, but the merocyanine dyes of the invention should not be limited to these examples.

(1)

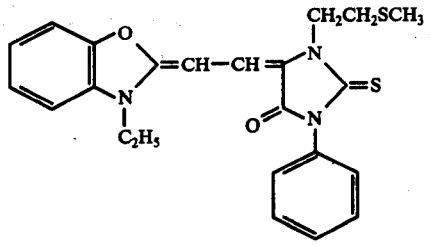

$\lambda_{max}^{MeOH}$: 491 nm (2)

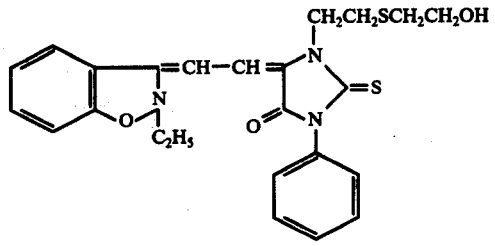

$\lambda_{max}^{MeOH}$: 491 nm (3)

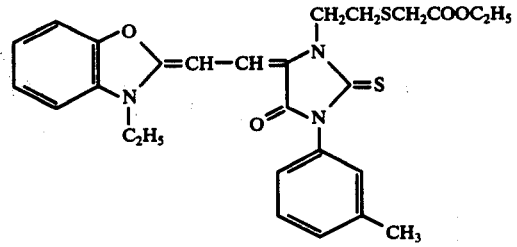

$\lambda_{max}^{MeOH}$: 491 nm

-continued
(4)
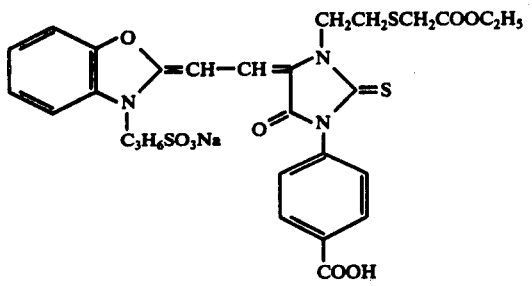
$\lambda_{max}^{MeOH}$ : 489 nm
(5)
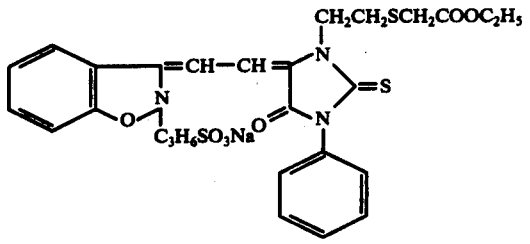
$\lambda_{max}^{MeOH}$ : 489 nm
(6)
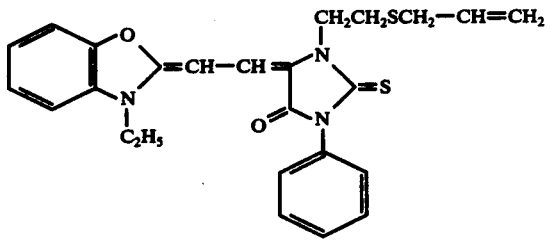
$\lambda_{max}^{MeOH}$ : 491 nm
(7)
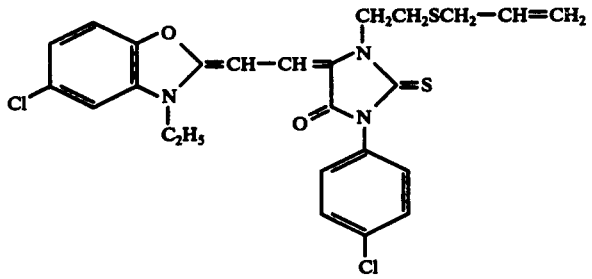
$\lambda_{max}^{MeOH}$ : 489 nm
(8)
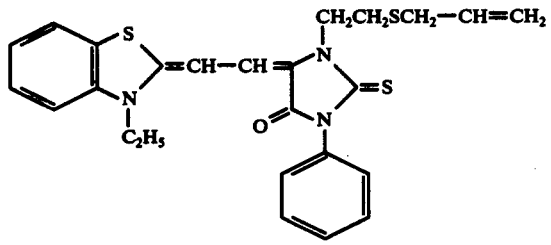
$\lambda_{max}^{MeOH}$ : 526 nm
(9)
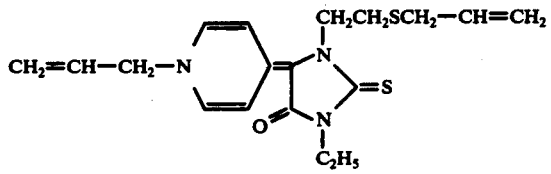
$\lambda_{max}^{MeOH}$ : 455 nm -continued
(10)
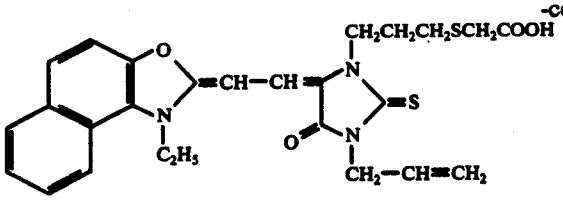
$\lambda_{max}^{MeOH}$: 505 nm
(11)
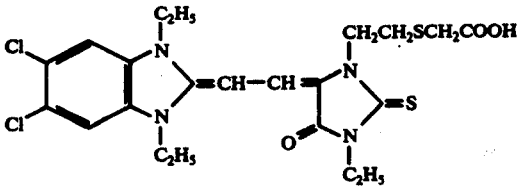
$\lambda_{max}^{MeOH}$: 509 nm
(12)
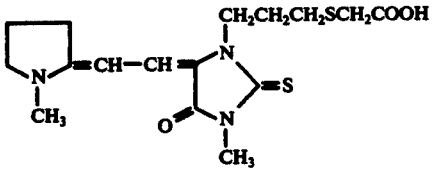
$\lambda_{max}^{MeOH}$: 471 nm
(13)
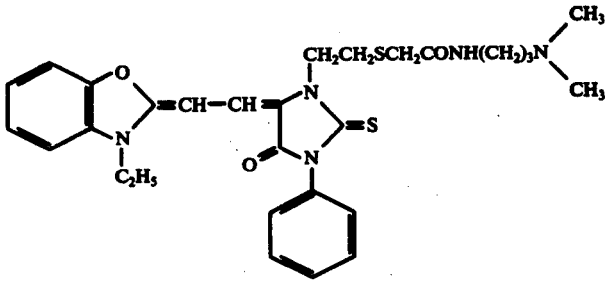
$\lambda_{max}^{MeOH}$: 492 nm
(14)
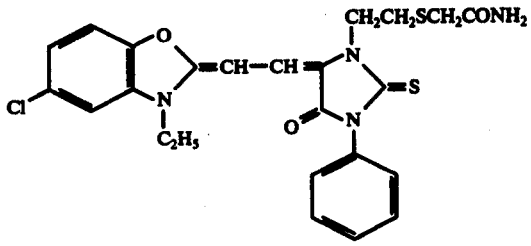
$\lambda_{max}^{MeOH}$: 490 nm
(15)
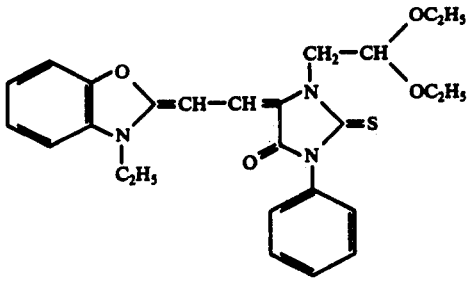
$\lambda_{max}^{MeOH}$: 490 nm
(16)
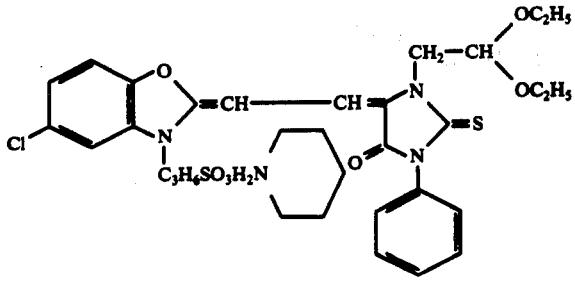
$\lambda_{max}^{MeOH}$: 487 nm -continued
(17)
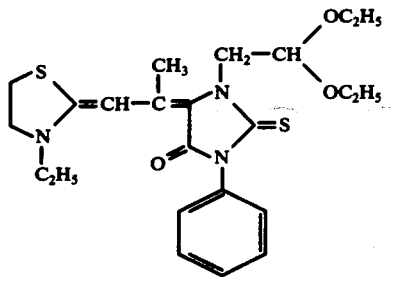
$\lambda_{max}^{MeOH}$ : 497 nm
(18)
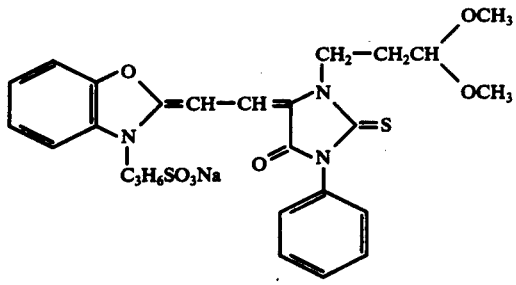
$\lambda_{max}^{MeOH}$ : 489 nm
(19)
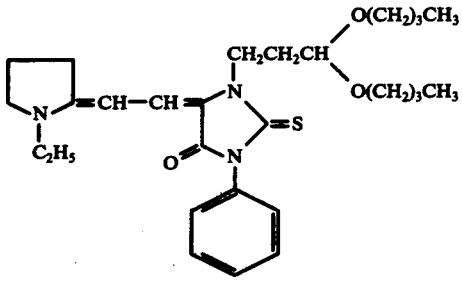
$\lambda_{max}^{MeOH}$ : 473 nm
(20)
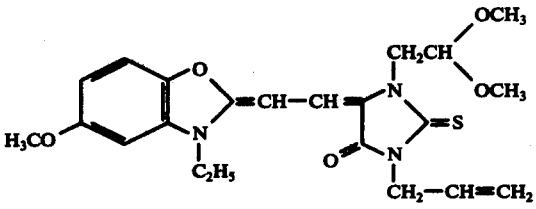
$\lambda_{max}^{MeOH}$ : 493 nm
(21)
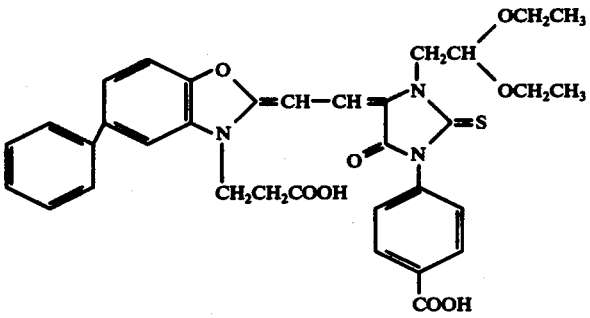
$\lambda_{max}^{MeOH}$ : 492 nm
(22)
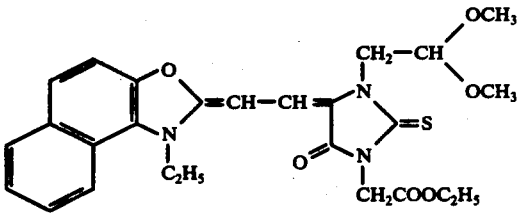
$\lambda_{max}^{MeOH}$ : 503 nm -continued (23)

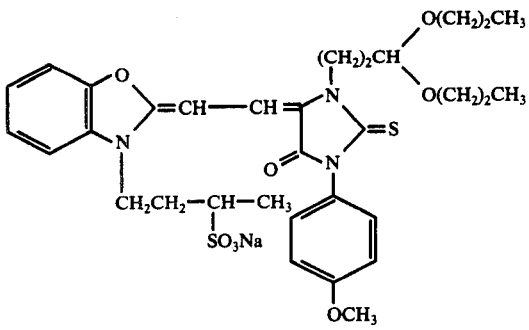

$\lambda_{max}^{MeOH}$ : 490 nm (24)

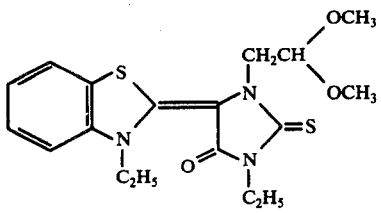

$\lambda_{max}^{MeOH}$ : 431 nm (25)

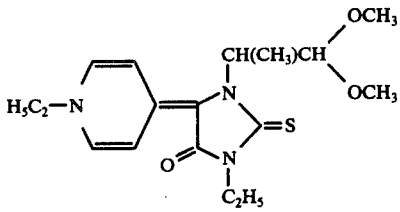

$\lambda_{max}^{MeOH}$ : 451 nm (26)

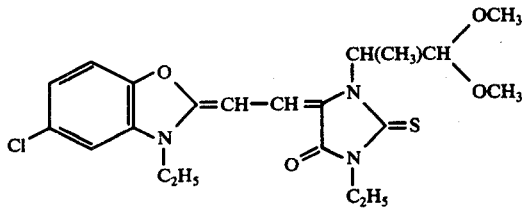

$\lambda_{max}^{MeOH}$ : 486 nm

Further, the formulae of comparative dyes (A) and (B) employed in the Example of this invention are as follows:

(A)

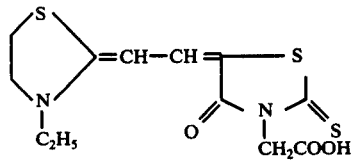

(B)

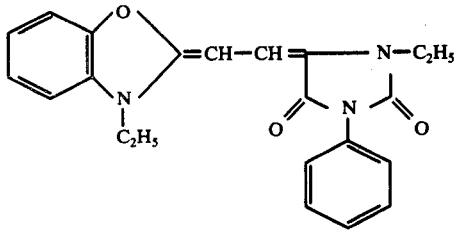

Representative synthesis examples of dyes employed in this invention are given below. Having thus generally described the invention, the following examples sets forth several preferred modes of practicing the present invention. Unless otherwise indicated, all processings were at room temperature and at atmospheric pressure.

SYNTHESIS EXAMPLE 1 (SYNTHESIS OF COMPOUND (6))

30 g of 2-aminoethanethiol was dissolved in 300 ml of methanol, and then 47.3 g of allyl bromide was dropwise added to the solution at 25° to 30° C with stirring. After 30 minutes, 108 ml of triethylamine and then 70.8 g of ethyl bromoacetate were gradually added to the solution while keeping the temperature at 25° to 30° C. After 30 minutes, 42 g of phenyl isothiocyanate and 200 ml of water were added and the system allowed to stand for 2 hours at 30° to 40° C with stirring.

Precipitated crystals were filtrated from the reaction mixture and recrystallized from ethanol on a boiling water bath to obtain 37.6 g of 1-(2-allylthio)ethyl-3-phenyl-2-thiohydantoin having a melting point of 78° to 80° C.

50 ml of ethyl alcohol and 3 ml of triethylamine were added to a mixture of 2.0 g of the 1-(2-allylthio)ethyl-3-phenyl-2-thiohydantoin and 3.0 g of 2-acetoanilidevinyl-3-ethylbenzoxazolium iodide and the mixture was refluxed for 30 minutes, followed by filtering the precipitated crystals, which were then recrystallized from a mixture of methyl alcohol and chloroform (V/V = 1:1) on a boiling water bath to obtain 2.5 g of Compound (6) having a red-orange color and a melting point of 194° C.

Synthesis Example 2 (Synthesis of Compound (15))

20.4 g of 2,2-diethoxyethylamine was dropwise added to 20 ml of ethyl acetate at 20° to 30° C with stirring. After one hour, the precipitated crystals were filtered and then 11 g of phenyl isothiocyanate was added to the filtered liquid and allowed to stand for 2 hours at 30° to 40° C.

After removing ethyl acetate at reduced pressure, the precipitated crystals were filtered and then recrystallized from acetone on a boiling water bath to obtain 18 g of 1-(2,2-diethoxy)ethyl-3-phenyl-2-thiohydantoin having a melting point of 98° to 101° C.

80 ml of ethyl alcohol and 5.5 ml of triethylamine were added to a mixture of 4 g of the 1-(2,2-diethoxy)ethyl-3-phenyl-2-thiohydantoin and 5.6 g of 2-acetoanilidivinyl-3-ethylbenzoxazolium iodide, and the system refluxed for 30 minutes, followed by filtering the precipitated crystals which were then recrystallized from a mixture of methyl alcohol and chloroform (V/V=1:1) on a boiling water bath to obtain 3.7 g of Compound (15) having red-orange color and a melting point of 167° to 168° C.

Other merocyanine dyes employed in the invention can be synthesized according to the above Synthesis Examples or U.S. Pat. Nos. 2,493,748, 2,493,747, 3,071,467, 2,497,876, 3,440,052, 3,440,051, 3,455,684, 3,379,533, 3,282,699, 3,480,439, 3,384,486, 3,364,026, 3,288,610, 2,743,273, 2,856,404, 2,882,159, 2,778,822, 2,519,001, 3,625,698, 2,497,878, 3,567,458 and Japanese Patent Publication No. 18108/71.

Merocyanine dyes of the invention can be used in combination with dyes as are disclosed in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026; Japanese Patent Application No. (OPI) 76525/73 and Belgian Patent No. 691,807, whereby photographic emulsions containing them can be supersensitized (super-additive increase of sensitivity).

The silver halide photographic emulsions employed in this invention can be prepared by any known conventional method, for example, an ammoniacal method, neutral method, acidic method, etc., by a single jet method, a double jet method or by combining methods therewith such as a precipitating method or a ripening method.

Silver halide particles of the invention can be silver chloride, silver bromide, silver iodide or mixtures thereof (e.g., AgClBr, AgClI, AgClBrI, AgBrI, etc.). Preferred silver halides in this invention are silver chlorobromide or silver chloroiodobromide in which the silver iodide content is about 0.1 to 8 mol%, preferably 0.2 to 5 mol%. Silver halides having any crystal habit can be used in this invention. The dyes of this invention are very useful for silver halides having a (1 1 1) plane, and particularly, are useful for silver halides having a (1 0 0) plane.

The average diameter of silver halide particles (measured, for example, by number average by the projected area method) is preferably about 0.04 micron to about 2 microns.

Preparation methods of silver halide photographic emulsions are disclosed in Mees, "The theory of Photographic Processes" published by MacMillan Co., and in P. Glafikides, "Photographic Chemistry" published by Fountain Press Co.

The photographic emulsions of this invention can be chemically sensitized by conventional methods, if desired, for example, a gold sensitization as disclosed in U.S. Pat. Nos. 2,540,085, 2,597,856, 2,597,915, 2,399,083, etc., a sensitization with a metal ion belonging to Group VIII of the Periodic Table as disclosed in U.S. Pat. Nos. 2,448,060, 2,540,086, 2,566,245, 2,566,263, 2,598,079, etc., a sulfur sensitization as disclosed in U.S. Pat. Nos. 1,574,944, 2,448,060, 2,399,083, 2,540,085, 2,540,086, 2,597,356, 2,278,947, 2,440,206, 2,410,689, 2,642,361, 3,189,458, 3,415,649, etc., a reduction sensitization as disclosed in U.S. Pat. Nos. 2,518,698, 2,419,974, 2,983,610, etc., or a combined sensitization method thereof.

As typical examples of chemical sensitizers, there are sulfur sensitizers such as allylthiocarbamide, thiourea, sodium thiosulfate, cystine, or sodium thiocyanate; gold or Group VIII metal sensitizers such as iridium (III) chloride, iridium (IV) chloride, iridium (III) bromide, potassium hexachloroiridate (III), potassium hexachloroiridate (IV), ammonium hexachloroplatinate (IV), potassium hexachloroplatinate (IV), potassium chloroaurate (III), gold (I) thiosulfate or potassium chloropalladate; reduction sensitizers such as tin chloride, phenyl hydrazine, reductone or derivative thereof; etc.

Other sensitizers such as polyoxyethylene derivatives, polyoxypropylene derivatives or derivatives having a quaternary ammonium group can also be employed in the invention, if desired.

The silver halide photographic emulsions of this invention can include azaindenes, mercaptotetrazoles, noble metal salts (e.g., palladium or platinum), oximes, imidazoles or salts thereof and tetrazolium salts as disclosed in U.S. Pat. Nos. 2,444,605, 2,886,437, 2,403,927, 3,266,897, 3,399,987, 2,597,915, 3,566,263, 2,694,716, 2,131,038, 2,518,698, 3,369,904, 2,419,974 and 2,419,975. For example, nitrobenzimidazole and ammonium chloroplatinate are employed as an antifoggant, and 4-hydroxy-6-methyl-1,3,3a,7-tetraazaindene is employed as a stabilizer.

The silver halide photographic emulsions of the invention can include a conventional hardening agent such as formaldehyde, chromium alum, the sodium salt of 1-hydroxy-3,5-dichlorotriazine, glyoxal or dichloroacrolein, if desired, and a coating aid such as saponin, sodium alkylbenzene sulfoante or a taurine derivative, if desired.

The silver halide photographic emulsions of the invention can include as a protective colloid those materials as are conventionally used in the art, e.g., gelatin, an acylated gelatin such as phthalated gelatin or malonated gelatin, a cellulose derivative such as hydroxyethyl cellulose or carboxymethyl cellulose, a water-soluble starch such as dextrin, or a hydrophilic synthetic polymer such as polyvinyl alcohol, polyvinyl pyrrolidone, polyacrylamide or polystyrene sulfonic acid and can further include, if desired, a plasticizer to improve dimensional stability, a latex polymer or a matting agent, as are conventionally used in the photographic art.

The finished emulsions can be coated on a support which does not affect the photographic properties of the emulsions. Such supports are conventional and include baryta paper, resin-coated papers, synthetic papers, cellulose triacetate films, polyethylene terephthalate films, glass plates, etc.

A spectral sensitizing dye employed in this invention can be added to photographic emulsions as an aqueous solution or as a solution of a water-miscible organic solvent such as methanol, ethanol, methyl cellosolve or pyridine in a conventional manner.

Methods for dispersing and then adding a spectral sensitizing dye to photographic emulsions are disclosed in U.S. Pat. Nos. 3,482,981, 3,469,987, 3,658,546 and 3,660,101, British Pat. Nos. 1,271,329 and 1,038,029, and German Patent Application (OPI) 2,107,283. Methods for absorbing a spectral sensitizing dye onto silica are disclosed in German patent application (OPI) No. 1,947,935. Methods for dissolving a spectral sensitizing dye into a solvent by ultrasonic waves are disclosed in U.S. Pat. No. 3,485,634. All such can be applied to this invention, if desired.

Spectral sensitization can be also carried out by the methods as disclosed in Japanese Patent Applications Nos. 128,754/74 and 128,775/73.

An amount of the merocyanine spectral sensitizing dye added is in accordance with those amounts usually employed for spectral sensitization, for example, about $1 \times 10^{-6}$ to about $5 \times 10^{-3}$ mol, preferably $1 \times 10^{-5}$ to $2.5 \times 10^{-3}$ mol, and most preferably $8 \times 10^{-5}$ to $1 \times 10^{-3}$ mol, per mol of silver.

The spectral sensitizing dye can be added to photographic emulsions during second ripening, directly before the completion of second ripening or after second ripening. It is preferred to add the same at a step after second ripening.

The results and advantages obtained by this invention are:

1. Silver halide photographic emulsions can be obtained which have markedly improved spectral sensitivity (particularly, green sensitivity) and less fog.

2. Silver halide photographic emulsions can be obtained where sensitivity is not lowered when light-sensitive photographic materials employing the emulsions are stored for long periods of time.

3. Silver halide photographic emulsions can be obtained which are not subject to residual color staining when they are developed.

4. The spectral sensitizing dyes employed in this invention have better solubility then prior art dyes and so are easily added to photographic emulsions.

5. The spectral sensitizing dyes of this invention can be easily synthesized in high yield.

Silver halide photographic emulsions containing one or more novel merocyanine dyes of this invention can be used for various black and white photographic light-sensitive materials, for example, photographic light-sensitive materials for conventional photography, for X-rays, light-sensitive materials exposable by other types of radiation, e.g., $\beta$-rays, $\gamma$-rays, etc., for holography, for diffusion transfer processes, for direct positives, for microphotography, for heat development, or for a light-sensitive material having high resolving power or for graphic arts. They can be also employed for multi-layer color photographic light-sensitive materials containing color couplers as disclosed in U.S. Pat. Nos. 3,152,896 and 3,615,502, and Japanese Patent Publication No. 13,111/69, mixed-grain type color photographic light-sensitive materials employing a packet emulsion, direct positive color photographic light-sensitive materials, color X-ray photographic materials, color diffusion transfer photographic materials, etc.

The spectral sensitization functions of the merocyanine dye of this invention are not affected by color couplers, and the merocyanine dyes of this invention do not sensitize an adjacent silver halide emulsion layer even when they diffuse into that layer.

The merocyanine dyes of this invention can be advantageously used for lithographic silver halide emulsions for increasing the blue- and green-sensitivity thereof and to adapt the emulsions to lithographic development, for example, preventing a degradation of development, improving image edge gradient and increasing the gamma value in the toe portion of the characteristic curve.

The merocyanine dyes of this invention are also suitable for the spectral sensitization of photographic emulsions for micro-copying, for heat-developable light-sensitive materials and for light-sensitive materials having high resolving power.

Where photographic emulsions of the invention are used for light-sensitive materials for lithography, they are imagewise exposed through a magenta contact screen having 150 lines/inch and then developed with any of the developers as follows:

| Developer (20° C; 3 minutes) I | |
|---|---|
| Sodium carbonate (monohydrate) | 50 g |
| Formaldehyde-sodium bisulfite adduct | 45 g |
| Potassium bromide | 2 g |
| Hydroquinone | 18 g |
| Sodium sulfite | 2 g |
| Water to make | 1 liter |

| Developer (20° C; 3 minutes) II | |
|---|---|
| Liquid I | |
| Distilled Water | 60 ml |
| Triethylene glycol | 30 ml |
| Formaldehyde-sodium bisulfite adduct | 45 g |
| Hydroquinone | 16 g |
| Distilled water to make | 125 ml |
| Liquid II | |
| Distilled water | 100 ml |
| Sodium carbonate (monohydrate) | 30 g |
| Sodium hydroxide | 5 g |
| Boric acid | 3 g |
| Sodium bromide | 2 g |
| Distilled water to make | 125 ml |

(In use, Liquid I is added to 750 ml of water and then Liquid II is added to make 1 liter)

| Developer (20° C 1 to 4 minutes) III | | |
|---|---|---|
| Water | 500 | ml |
| Hydroquinone | 15 | g |
| Formaldehyde-sodium bisulfite adduct | 50 | g |
| Potassium carbonate | 35 | g |
| Triethanolamine | 90 | ml |
| Sodium sulfite | 2.5 | g |
| Boric acid | 5 | g |
| Potassium bromide | 2 | g |
| Water to make | 1 | liter |

As a fixing solution, the following composition can be used.

| Fixing Solution | | |
|---|---|---|
| Water | 600 | ml |
| Sodium thiosulfate | 360 | g |
| Ammonium sulfate | 60 | g |
| Sodium sulfite (anhydrous) | 15 | g |
| Glacial acetic acid | 13.5 | g |
| Boric acid | 7.5 | g |
| Potassium alum | 15 | g |
| Water to make | 1 | liter |

Of course, the processing solutions employed in the invention are not limited to the above examples.

EXAMPLE

A silver chloroiodobromide emulsion (iodide content 0.25 mol%; bromide content 16.5 mol%) was prepared by precipitating silver halide particles by the double-jet method, physically ripening the same by a conventional method, desalting and then chemically ripening the emulsion with hydrochloroauric acid. The average diameter of silver halide particles in the emulsion was 0.4 micron. In 1 kg of the emulsion, 1.18 mol of silver halide was present. 1 kg of the emulsion was weighed out and melted in a thermostatic bath at 50° C.

Spectral sensitizing dyes of the invention and dyes for comparison were added as a methanol solution to the emulsion, and mixed therewith at 40° C with stirring.

To the resulting emulsion, 20 cc of a 1 wt% aqueous solution of 4-hydroxy-6-methyl-1,3,3a,7-tetraazaindene and 10 cc of a 1 wt% aqueous solution of the sodium salt of 1-hydroxy-3,5-dichlorotriazine were added, and then 10 cc of a 1 wt% aqueous solution of sodium dodecylbenzene sulfonate was added and the emulsion mixed well.

The finished emulsion was coated on a cellulose triacetate film to a dry thickness of 5 microns and dried to provide samples of light-sensitive materials (Samples). These Samples were divided to obtain strips. A portion of the strips was allowed to stand for 2 days at 50° C and at a relative humidity of 80%. Fresh Samples and incubated Samples which were allowed to stand under high temperature and high humidity were thus prepared.

A pair of these Samples (one fresh, one incubated) was wedge exposed through a blue filter (Wratten 47 B) Wratten is a Trade Mark) or a green filter (Wratten 58) to a sensitometer having a color temperature of 5400° K. Another pair of Samples was exposed using a diffraction grating type spectrographic camera having a tungsten light source of 2666° K to obtain a spectrogram.

The exposed Samples were developed with the following developer for 2 minutes at 20° C, followed by stopping, fixing and washing in a conventional manner to obtain strips having black and white images. Densities of the images were measured using an S-type densitometer manufactured by Fuji Photo Film Co. Ltd. to obtain the blue-sensitivity ($S_B$), green-sensitivity ($S_G$) and fog thereof. The standard point of optical density employed for deciding the sensitivity was fog +0.20.

| Developer | |
|---|---|
| Water | 500 ml |
| Metol | 2 g |
| Sodium sulfite (anhydrous) | 40 g |
| Hydroquinone | 4 g |
| Sodium carbonate monohydrate | 28 g |
| Potassium bromide | 1 g |
| Water to make | 1 liter |

For use, an additional 1 liter of water was added to the developer. The thus obtained results are shown in Table 1 as relative values. In Table 1, the relative value of blue-sensitivity, the relative value of green-sensitivity and the relative value of fog obtained by using merocyanine dyes of this invention and comparative dyes are shown.

As is apparent from Table 1, it can be understood that the novel spectral sensitizing dyes of this invention provide a higher spectral sensitization than the comparative dyes, and do not generate residual color. The latter can be understood by the fact that the fog does not change in comparison with the control (Fresh) emulsion. Further, neither sensitivity nor fog in the Samples allowed to stand for 2 days at 50° C and at 80% relative humidity changed.

Table 1

| | | (Fresh Samples) | | | |
|---|---|---|---|---|---|
| Spectral sensitizer | Amount of sensitizer per Kg of emulsion ($\times 10^{-5}$ mol) | $S_G$ (relative value) | $S_B$ (relative value) | Fog | Sensitization maximum (nm) |
| — | — | ** | 100* | 0.04 | |
| (1) | 16 | 171 | 157 | 0.04 | 540 |
| | 32 | 188 | 186 | 0.04 | 540 |
| (2) | 16 | 154 | 110 | 0.04 | 540 |
| | 32 | 160 | 115 | 0.04 | 540 |
| (3) | 16 | 145 | 140 | 0.04 | 540 |
| | 32 | 180 | 123 | 0.04 | 540 |
| (6) | 16 | 168 | 140 | 0.04 | 540 |
| | 32 | 182 | 146 | 0.04 | 540 |
| (7) | 16 | 168 | 140 | 0.04 | 540 |
| | 32 | 168 | 140 | 0.04 | 540 |
| (15) | 16 | 193 | 150 | 0.04 | 540 |
| | 32 | 211 | 155 | 0.04 | 540 |
| (16) | 16 | 218 | 161 | 0.04 | 545 |
| | 32 | 218 | 161 | 0.04 | 545 |
| (A) | 8 | 87 | 77 | 0.04 | 540 |
| comparison | 16 | 84 | 59 | 0.04 | 540 |
| (B) | 8 | 71 | 103 | 0.04 | 540 |
| comparison | 16 | 100* | 114 | 0.04 | 540 |

*Control (Sensitivity $S_G$ is the value relative to the value (100) obtained using $16 \times 10^{-5}$ mol per Kg of emulsion of dye (B), and sensitivity $S_B$ is the value relative to the value of the original emulsion as 100, i.e., free of sensitizing dye).
**Too low a value; could not be measured.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing at least one spectral sensitizing dye represented by formula (I)

(I)

-continued

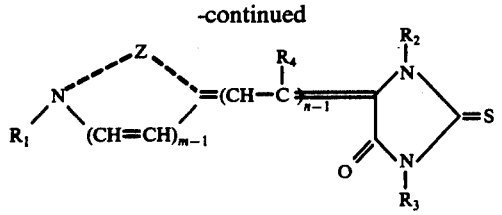

wherein Z is an atomic group necessary for completing a 5- or 6-membered heterocyclic ring, such atomic group consisting of at least one carbon atom and of one or more nitrogen, oxygen, sulphur or selenium atoms, $R_1$ is an aliphatic group, $R_2$ is an aliphatic group having an alkylthio group or is an aliphatic group having two alkoxy groups on the same carbon atom, $R_3$ is an aryl group, an alkyl group or an alkenyl group, $R_4$ is a hydrogen atom, an alkyl group or an aryl group, m and n is 1 or 2.

2. The photographic emulsion as claimed in claim 1, wherein Z is the atomic group necessary to complete an oxazole nucleus, a benzoxazole nucleus, a benzisooxazole nucleus, a naphthoxazole nucleus, a thiazoline nucleus, a thiazole nucleus, a benzothiazole nucleus, a naphthothiazole nuncleus, a selenazole nucleus, a benzoselenazole nucleus, a naphthoselenazole nucleus, a quinoline nucleus, an isoquinoline nucleus, an indolenine nucleus, a pyridine nucleus, a benzimidazole nucleus, a naphthoimidazole nucleus, a pyrrole nucleus, a pyrrolidine nucleus or a tetrazole nucleus.

3. The photographic emulsion as claimed in claim 2, wherein $R_1$ is an unsubstituted alkyl group, a sulfoalkyl group, a hydroxy-sulfoalkyl group, a sulfoalkoxyalkyl group, a carboxyalkyl group, a hydroxyalkyl group, an alkoxyalkyl group, a hydroxyalkoxyalkyl group, an acyloxyalkoxyalkyl group, an acyloxyalkyl group, an alkoxycarbonylalkyl group, a sulfoxyalkyl group, an aralkyl group or an alkenyl group.

4. The photographic emulsion as claimed in claim 3, wherein $R_3$ is an aryl group, an alkylaryl group, an alkoxyaryl group, a carboxyaryl group, a halogen-substituted aryl group, an alkoxycarbonylaryl group, a sulfoaryl group, an alkyl group, a sulfoalkyl group, an alkoxycarbonylalkyl group, a dialkylaminoalkyl group, an alkoxyalkyl group or a carboxyalkyl group or an alkenyl group.

5. The photographic emulsion as claimed in claim 4, wherein Z is the atomic group necessary for completing a benzoxazole nucleus, a benzisooxazole nucleus, a naphthoxazole nucleus, a thiazoline nucleus, a thiazole nucleus, a benzothiazole nucleus, a naphthothiazole nucleus, a benzoselenazole nucleus, a 2-pyridine nucleus, a 4-pyridine nucleus, a benzimidazole nucleus, or a pyrrolidine nucleus, $R_1$ is an unsubstituted alkyl group, a sulfoalkyl group, a sulfoalkoxyalkyl group, a hydroxy-sulfoalkyl group, a carboxyalkyl group, a sulfoxyalkyl group or an alkenyl group, $R_2$ is an alkyl group having 1 to 4 carbon atoms and having an alkylthio group of which the alkyl moiety has 1 to 4 carbon atoms, or is an alkyl group having 1 to 6 carbon atoms and having two alkoxy groups, each having 1 to 4 carbon atoms, on the same carbon atom, $R_3$ is an unsubstituted phenyl group, p-carboxyphenyl group, p-chlorophenyl group, p-sulfophenyl group, an unsubstituted alkyl group having 1 to 6 carbon atoms, a sulfoalkyl group having 1 to 6 carbon atoms, a carboxyalkyl group having 1 to 6 carbon atoms, an alkoxycarbonylalkyl group having 1 to 6 carbon atoms in the alkyl moiety or an alkenyl group, and $R_4$ is a hydrogen atom, an alkyl group having 1 to 4 carbon atoms, a phenyl group or a substituted phenyl group.

6. The photographic emulsion as claimed in claim 5, wherein Z is the atomic group necessary for completing a benzoxazole nucleus, a benzisooxazole nucleus or a naphthoxazole nucleus, and $R_2$ is a dialkoxyalkyl group consisting of an alkyl group having 1 to 4 carbon atoms and having two alkoxy groups on the same carbon atom of the alkyl group, each of alkoxy groups having 1 to 3 carbon atoms.

7. The photographic emulsion as claimed in claim 6, wherein $R_1$ is an unsubstituted alkyl group having 1 to 4 carbon atoms; a hydroxyalkyl group having an alkyl moiety of 1 to 4 carbon atoms; a sulfoalkyl group having an alkyl moiety of 1 to 4 carbon atoms; a carboxyalkyl group having an alkyl moiety of 1 to 4 carbon atoms or an alkenyl group, $R_3$ is a phenyl group, a p-chlorophenyl group, a p-carboxyphenyl group, an unsubstituted alkyl group having 1 to 4 carbon atoms, a sulfoalkyl group having an alkyl moiety of 1 to 4 carbon atoms, a carboxyalkyl group having an alkyl moiety of 1 to 4 carbon atoms, an alkoxycarbonylalkyl group having an alkyl moiety of 1 to 4 carbon atoms or an alkenyl group, and $R_4$ is a hydrogen atom or an alkyl group having up to 2 carbon atom.

* * * * *